US006542046B2

(12) United States Patent
Kitamori et al.

(10) Patent No.: US 6,542,046 B2
(45) Date of Patent: Apr. 1, 2003

(54) DIRECTIONAL COUPLER, ANTENNA DEVICE, AND RADAR SYSTEM

(75) Inventors: Nobumasa Kitamori, Nagaokakyo (JP); Toshiro Hiratsuka, Yokohama (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/929,928

(22) Filed: Aug. 15, 2001

(65) Prior Publication Data

US 2002/0030554 A1 Mar. 14, 2002

(30) Foreign Application Priority Data

Sep. 8, 2000 (JP) ..... 2000-273345

(51) Int. Cl.[7] ..... H01P 5/12

(52) U.S. Cl. ..... 333/113; 333/248; 333/208; 333/239; 343/776

(58) Field of Search ..... 333/113, 239, 333/248, 208; 343/776

(56) References Cited

U.S. PATENT DOCUMENTS

| | | | | |
|---|---|---|---|---|
| 5,640,700 A | * | 6/1997 | Shingyoji et al. | 333/250 |
| 5,770,989 A | | 6/1998 | Ishikawa et al. | |
| 5,811,855 A | | 9/1998 | Tyson et al. | |
| 5,867,120 A | * | 2/1999 | IshiKawa et al. | 342/175 |
| 5,892,414 A | * | 4/1999 | Doughty et al. | 333/137 |
| 5,920,245 A | | 7/1999 | Toru et al. | |
| 6,094,106 A | * | 7/2000 | Kishino et al. | 333/113 |
| 6,147,569 A | * | 11/2000 | Kishino et al. | 333/113 |
| 6,307,451 B1 | * | 10/2001 | Saitoh et al. | 333/239 |
| 6,331,809 B1 | * | 12/2001 | Takakuwa et al. | 333/135 |
| 6,362,696 B1 | * | 3/2002 | Ishikawa et al. | 331/107 G |
| 2001/0013842 A1 | * | 8/2001 | Ishikawa et al. | 343/912 |

FOREIGN PATENT DOCUMENTS

| | | |
|---|---|---|
| EP | 0793288 | 9/1997 |
| EP | 0969545 | 1/2000 |
| JP | 08008621 | 1/1996 |
| JP | 10200331 | 7/1998 |
| JP | 10-242470 | 9/1998 |
| JP | 11-233785 | 8/1999 |

OTHER PUBLICATIONS

Dallaire J. et al, "Complete Characterization of Transmission Losses in Generalized Nonradiative Dielectric (NRD) Waveguide," IEEE Transactions on Microwave Theory and Techniques, IEEE Inc. New York, vol. 48, No. 1 (Jan. 2000) pp. 121–125.

F. Kuroki et al., "Transmission Characteristics of LSE01 Mode in High Permittivity NRD Guide," 1997 Asia–Pacific Microwave Conference—Proceedings, Hong Kong (Dec. 2–5, 1997), pp. 593–596.

(List continued on next page.)

*Primary Examiner*—Michael Tokar
(74) *Attorney, Agent, or Firm*—Dickstein, Shapiro, Morin & Oshinsky, LLP.

(57) ABSTRACT

A directional coupler includes two non-radiative dielectric lines, each formed by a dielectric strip between flat conductive surfaces placed substantially parallel to each other, such that the two non-radiative dielectric lines are close to each other. The main transmission mode of electromagnetic waves at the frequency used is an LSE mode, the electromagnetic waves being propagated in the non-radiative dielectric lines. Therefore, the insertion loss due to mode switching in the coupling portion of the primary line and the secondary line which form the directional coupler can be reduced, and leakage of the electromagnetic waves from the gap between the primary line and the secondary line of the directional coupler when they are separated from each other can be suppressed.

7 Claims, 7 Drawing Sheets

OTHER PUBLICATIONS

Liqun Xu et al., "Theoretical and Experimental Research on Nonradiative Dielectric Waveguide Directional Couplers," International Journal of Infrared and Millimeter Waves, Plenum Publishing, New York, vol. 9, No. 3 (Mar. 1988), pp. 265–272.

Fariborz Assaderaghi et al., "A Dynamic Threshold Voltage MOSFET (DTMOS) for Very Low Voltage Operation," IEEE Electron Device Letters, IEEE Inc., New York, vol. 15, No. 12, Dec. 1, 1994.

* cited by examiner

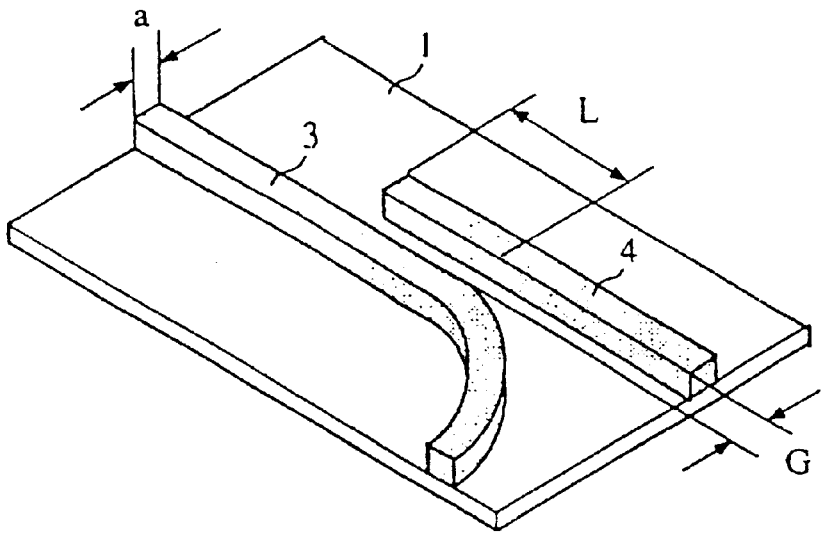
FIG. 1
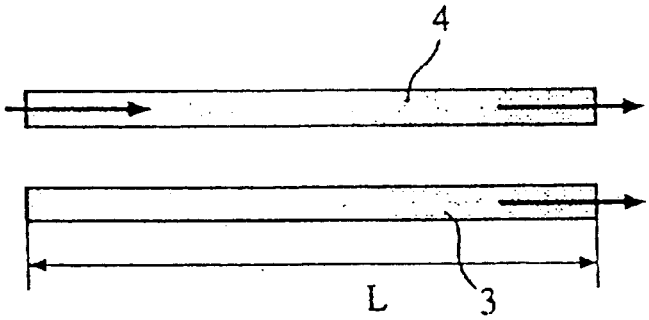
Coupling Length
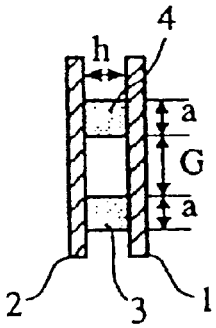
FIG. 2B
FIG. 2A

DIRECTIONAL COUPLER, ANTENNA DEVICE, AND RADAR SYSTEM

BACKGROUND OF THE INVENTION

1. Field of the Invention

The present invention relates to a directional coupler using dielectric lines as transmission paths, an antenna device incorporating the directional coupler, and a radar system including the antenna device.

2. Description of the Related Art

A directional coupler using dielectric lines as transmission paths is disclosed in Japanese Unexamined Patent Application Publications Nos. 8-8621 and 10-200331.

Japanese Unexamined Patent Application Publication No. 8-8621 is related to a directional coupler which uses a non-radiative dielectric waveguide (hereinafter referred to as "NRD guide"). Because of its low transmission loss in a single NRD guide, the LSM mode is used as a transmission mode in a coupling portion of the directional coupler. A bent portion has a radius of curvature of one of several discrete values so as to provide lower loss. The directional coupler is adapted to propagate electromagnetic waves in both the LSM mode and the LSE mode. Therefore, problems arise in that mode switching is likely to occur in the directional coupling portion, resulting in ripples in the insertion loss versus frequency characteristic.

Japanese Unexamined Patent Application Publication No. 10-200331 is directed to an antenna device incorporating a directional coupler which uses dielectric lines as transmission paths, in which the secondary line is moved parallel to the primary line to achieve beam scanning. A gap between the two lines of the directional coupler forms a choke, thereby preventing leaky wave loss. However, when the directional coupler is adapted to propagate electromagnetic waves in the LSM mode and the LSE mode, loss resulting from mode switching occurs, as in the directional coupler disclosed in Japanese Unexamined Patent Application Publication No. 8-8621. If the electromagnetic waves are propagated solely in the LSM01 mode as a primary mode, there are also problems in that the electromagnetic waves are likely to leak from the gap between the primary line and the secondary line, possibly increasing the insertion loss.

SUMMARY OF THE INVENTION

Accordingly, the present invention provides a compact directional coupler which solves the problems of increased insertion loss due to mode switching in the coupling portion of the primary line and the secondary line which form the directional coupler, which has improved design flexibility in the bent portion, and which suppresses leakage of the electromagnetic waves from the gap between the primary line and the secondary line of the directional coupler when they are separated from each other.

The present invention further provides a compact antenna device incorporating a compact directional coupler having lower loss, which achieves high rate beam scanning, and provides a compact radar system having a high detection ability using the antenna device.

To this end, a directional coupler includes two non-radiative dielectric lines, each having flat conductive surfaces placed substantially in parallel to each other, and a dielectric strip disposed therebetween, the two non-radiative dielectric lines being coupled to each other so that at least portions of the dielectric strips are close to and extend in parallel to each other. The main transmission mode of electromagnetic waves at the frequency used is an LSE mode, the electromagnetic waves being propagated in the non-radiative dielectric lines. The LSE mode is used as a main transmission mode, thereby maintaining low loss and realizing a compact directional coupler.

Preferably, the cross-sectional dimension of the dielectric strips and the spacing between the flat conductive surfaces are defined so that electromagnetic waves at the frequency used may be propagated solely in the LSE mode in the non-radiative dielectric lines. Therefore, the loss caused by mode switching between the LSE mode and the LSM mode in the bent portion can be suppressed.

The two non-radiative dielectric lines which form the directional coupler may be separated by separating surfaces extending along the longitudinal direction of the two dielectric strips, and the two non-radiative dielectric lines may be placed in the longitudinal direction of the dielectric strips so as to be relatively displaced with respect to each other. Therefore, the two non-radiative dielectric lines can be relatively displaced with respect to each other while they are coupled to each other, thereby reducing the loss due to leakage of electromagnetic waves from the separating surfaces.

Each of the two non-radiative dielectric lines may include conductive plates which hold the dielectric strip, and the opposing surfaces of the conductive plates, which correspond to the separating surfaces of the non-radiative dielectric lines, preferably have choke grooves formed therein. This reliably suppresses leakage of the electromagnetic waves in the LSE mode from a gap between the opposing surfaces of the conductive plates.

In another aspect of the present invention, an antenna device includes a primary emitter connected to one of two non-radiative dielectric lines in a directional coupler which are separated from each other, and a dielectric lens which substantially focuses onto the primary emitter. Therefore, the primary emitter can be relatively displaced with respect to the dielectric lens when the two non-radiative dielectric lines in the directional coupling portion are relatively displaced, thereby achieving high rate beam scanning.

In still another aspect of the present invention, a radar system includes a unit for transmitting and receiving electromagnetic waves, and the unit includes the above-described antenna device. Therefore, the overall radar system becomes compact since it incorporates an antenna device including a compact and light-weight directional coupler, and can achieve high rate beam scanning.

Other features and advantages of the present invention will become apparent from the following description of embodiments of the invention which refers to the accompanying drawings.

BRIEF DESCRIPTION OF THE DRAWINGS

FIG. 1 is a perspective view of a directional coupler according to a first embodiment of the present invention, with an upper conductive plate removed therefrom;

FIGS. 2A and 2B are a top view and a cross-sectional view, respectively, of a coupled two-line model of the directional coupler shown in FIG. 1;

DETAILED DESCRIPTION OF EMBODIMENTS OF THE INVENTION

Figure 3A:
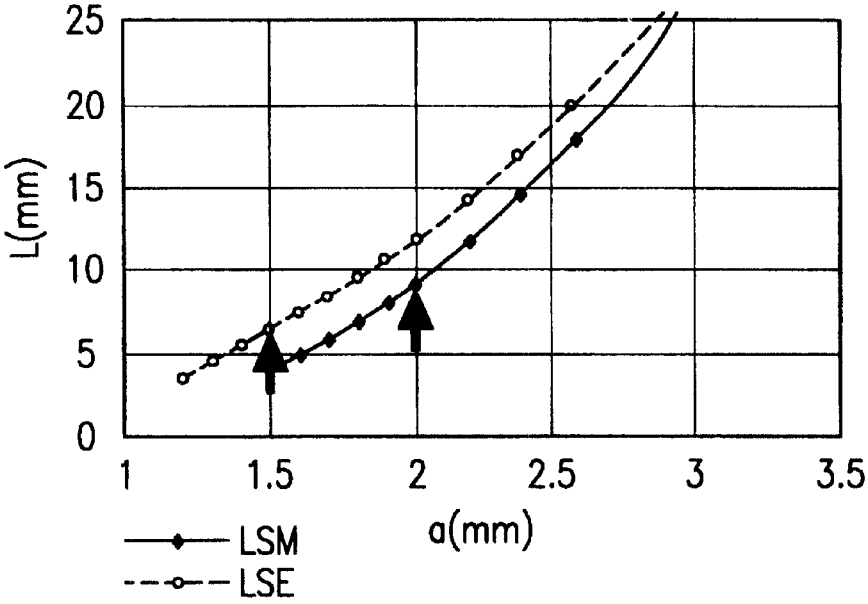
FIGS. 3A and 3B are graphs showing an example of characteristics of the coupled two-line model.

A directional coupler according to a first embodiment of the present invention is described with reference to FIGS. 1 to 3B.

FIG. 1 is a perspective view of the directional coupler, with an upper conductive plate removed therefrom. Referring to FIG. 1, the directional coupler includes a lower conductive plate 1, and dielectric strips 3 and 4 which are formed by cutting a material such as polytetrafluoroethylene (PTFE). The directional coupler further includes an upper conductive plate 2 (see FIG. 2B) which is disposed in parallel to the lower conductive plate 1 so that the dielectric strips 3 and 4 may be sandwiched between the upper and lower conductive plates 1 and 2.

In the illustration of FIG. 1, the dielectric strip 3 has a straight portion and a bent portion, and is close to, while being spaced by coupling gap G, from a straight portion of the dielectric strip 4 so as to extend in parallel thereto over length L.

FIGS. 2A and 2B illustrate an exemplary coupled two-line model which substantially corresponds to a directional coupling portion of the directional coupler shown in FIG. 1. FIG. 2A is a top view of the dielectric strips 3 and 4, and FIG. 2B is a cross-sectional view of the dielectric strips 3 and 4 taken along the plane perpendicular to the axes of the dielectric strips 3 and 4. In FIGS. 2A and 2B, the coupling length of the two coupled lines is indicated by L, the spacing between the upper and lower conductive plates 1 and 2 is indicated by h, the width of the dielectric strips 3 and 4 is indicated by a, and the coupling gap is indicated by G. In this illustration, G=0.4 mm and h=1.8 mm.

Figure 3B:
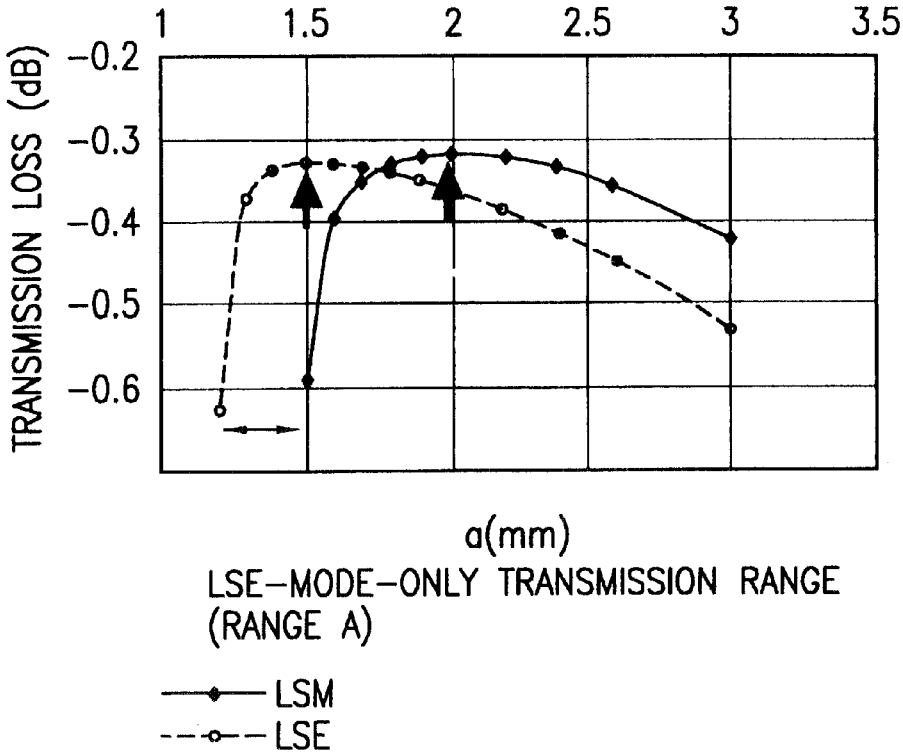

FIGS. 3A and 3B show characteristics for the LSM mode and the LSE mode as transmission modes on the model shown in FIGS. 2A and 2B. FIG. 3A is a characteristic showing the coupling length L for a coupling amount of 0 dB as the width a of the dielectric strips 3 and 4 varies. FIG. 3B is a characteristic showing the transmission loss as the width a varies.

As shown in FIG. 3B, when the directional coupler using electric field coupling in the LSM mode is formed, the optimum line width a that provides the minimum transmission loss is 2.0 mm, and when the directional coupler using magnetic field coupling in the LSE mode is formed, the optimum line width a that provides the minimum transmission loss is 1.5 mm. As shown in FIG. 3A, the coupling length that provides the minimum insertion loss in the directional coupler using electric field coupling in the LSM mode is 9.2 mm, and the coupling length that provides the minimum insertion loss in the directional coupler using magnetic field coupling in the LSE mode is 6.5 mm.

Typically, in a single NRD guide, the transmission mode used is the LSM mode, while the LSE mode is an undesirable mode, because the transmission loss in the LSM mode is lower than the transmission loss in the LSE mode. In the directional coupler, however, as shown in FIG. 3B, there is substantially no difference in transmission loss between the LSM mode and the LSE mode. Rather, the coupling length of the directional coupler can be shorter when the LSE mode is utilized than when the LSM mode is utilized, thereby achieving a compact directional coupler. In addition, when the directional coupler using magnetic field coupling in the LSE mode provides the optimum coupling length (a=1.5 mm), the LSM mode is substantially cut off, as shown in FIG. 3B, where transmission solely in the LSE mode is substantially achieved. A range A (where a equals approximately 1.25 to 1.5 mm) shown in FIG. 3B represents an LSE-mode-only transmission range. Conversely, the LSM mode is an undesirable mode, and coupling in such undesirable mode is prevented.

A directional coupler according to a second embodiment of the present invention is described with reference to FIGS. 4A to 7.

Figure 4A:
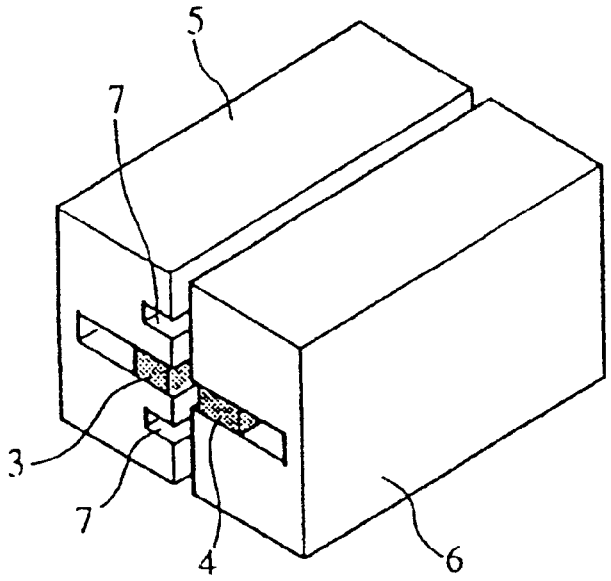
FIGS. 4A and 4B are a perspective view and a cross-sectional view, respectively, of a directional coupler according to a second embodiment of the present invention.
Figure 4B:
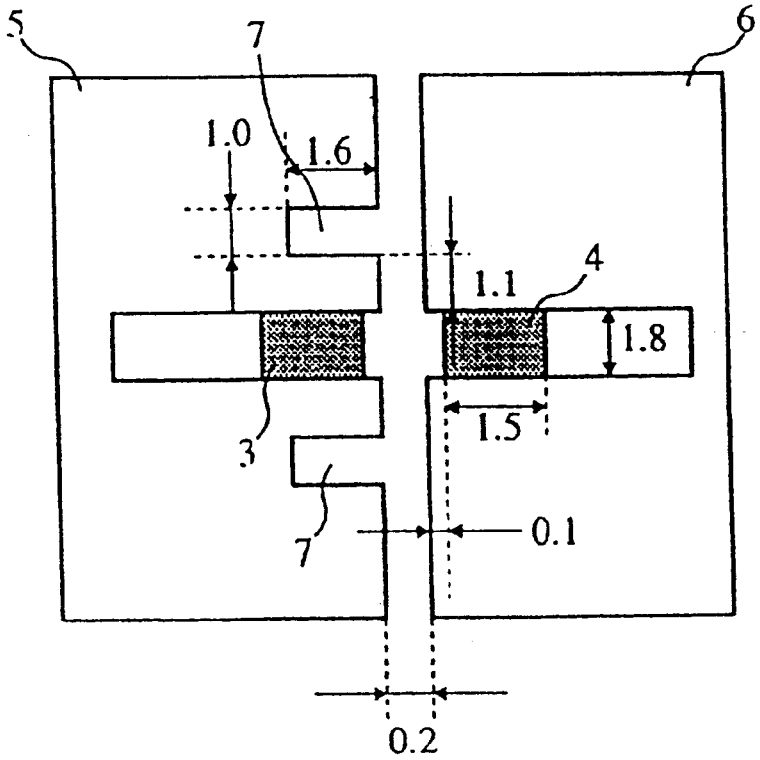

FIG. 4A is a perspective view of a coupled two-line portion of the directional coupler, and FIG. 4B is a cross-sectional view of the coupled two-line portion taken along the plane perpendicular to the axes of the dielectric strips 3 and 4. In FIGS. 4A and 4B, block-shaped conductive plates 5 and 6, made of metal, each have main grooves formed therein so as to provide flat conductive surfaces which are placed in parallel to each other, and the dielectric strips 3 and 4 are respectively received in the main grooves. The block-shaped metal plate 5 and the dielectric strip 3 form an NRD guide, and the block-shaped metal plate 6 and the dielectric strip 4 form another NRD guide. The opposing surfaces of the block-shaped metal plates 5 and 6 correspond to "separating surfaces of the non-radiative dielectric lines" in accordance with the present invention. The separating surface of the block-shaped metal plate 5 has choke grooves 7 formed therein so as to extend in the depth direction which is perpendicular to the separating surface. The position and depth of the choke grooves 7 are defined so that a short circuit occurs at the locations where they are spaced substantially an integral multiple of a half wavelength of the transmission wave apart from the flat conductive surfaces that are brought into contact with the upper and lower surfaces of the dielectric strip 3. For illustration, the dimensions of the components shown in FIG. 4B are in mm in the case where the frequency used is 76.5 GHz and where the directional coupler uses magnetic coupling in the LSE mode.

Figure 6:
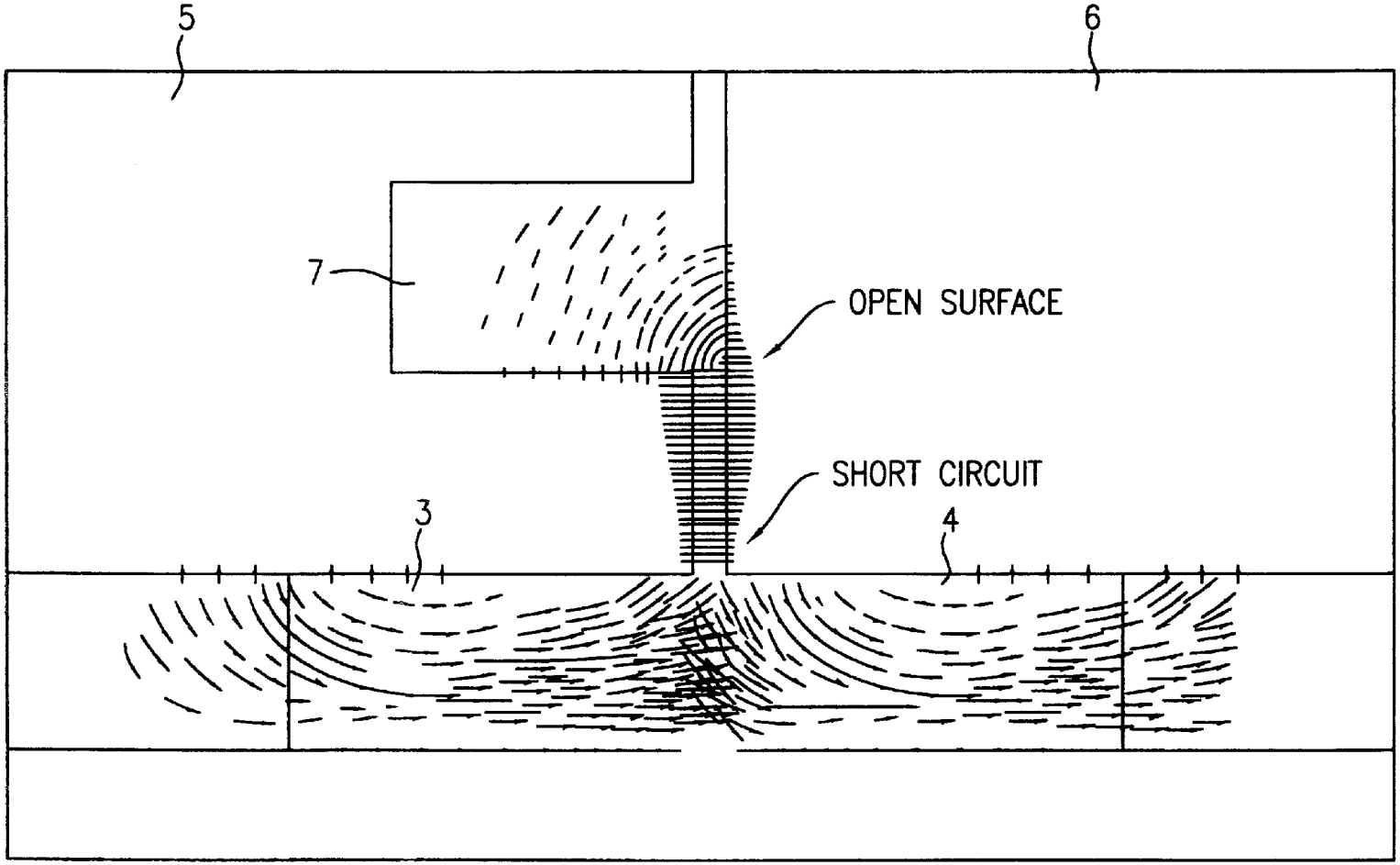
FIG. 6 schematically illustrates the electric field distribution in the main portion of a directional coupler as a comparative example.
Figure 7:
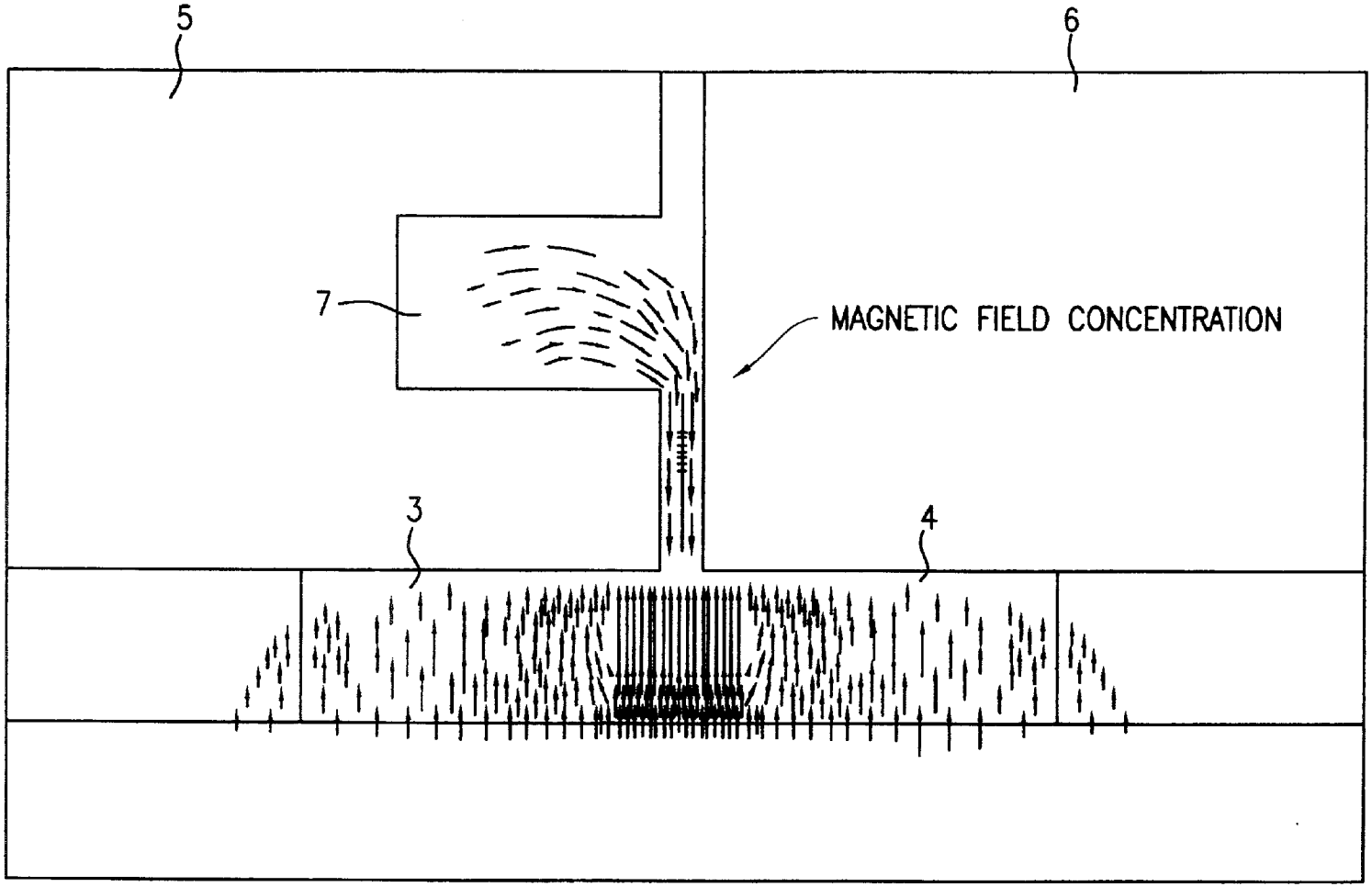
FIG. 7 schematically illustrates the magnetic field distribution in the main portion of a directional coupler as a comparative example.

FIGS. 6 and 7 show how electromagnetic waves leak at separating surfaces of a conventional directional coupler which uses electric field coupling in the LSM mode. FIG. 6 illustrates the electric field distribution and FIG. 7 illustrates the magnetic field distribution. As can be understood from FIGS. 6 and 7, in the directional coupler using electric field coupling in the LSM mode, the conductor is divided by the separating surfaces perpendicularly to the direction in which a current flows, so that the current is blocked by the separating surfaces, thereby producing a larger amount of leakage of the electromagnetic waves. Conventionally, the grooves 7 are used as chokes in order to suppress leakage of the electromagnetic waves from the separating surfaces of the conductor; however, a loss of approximately 0.2 to 0.3 dB is inevitable.

Figure 5:
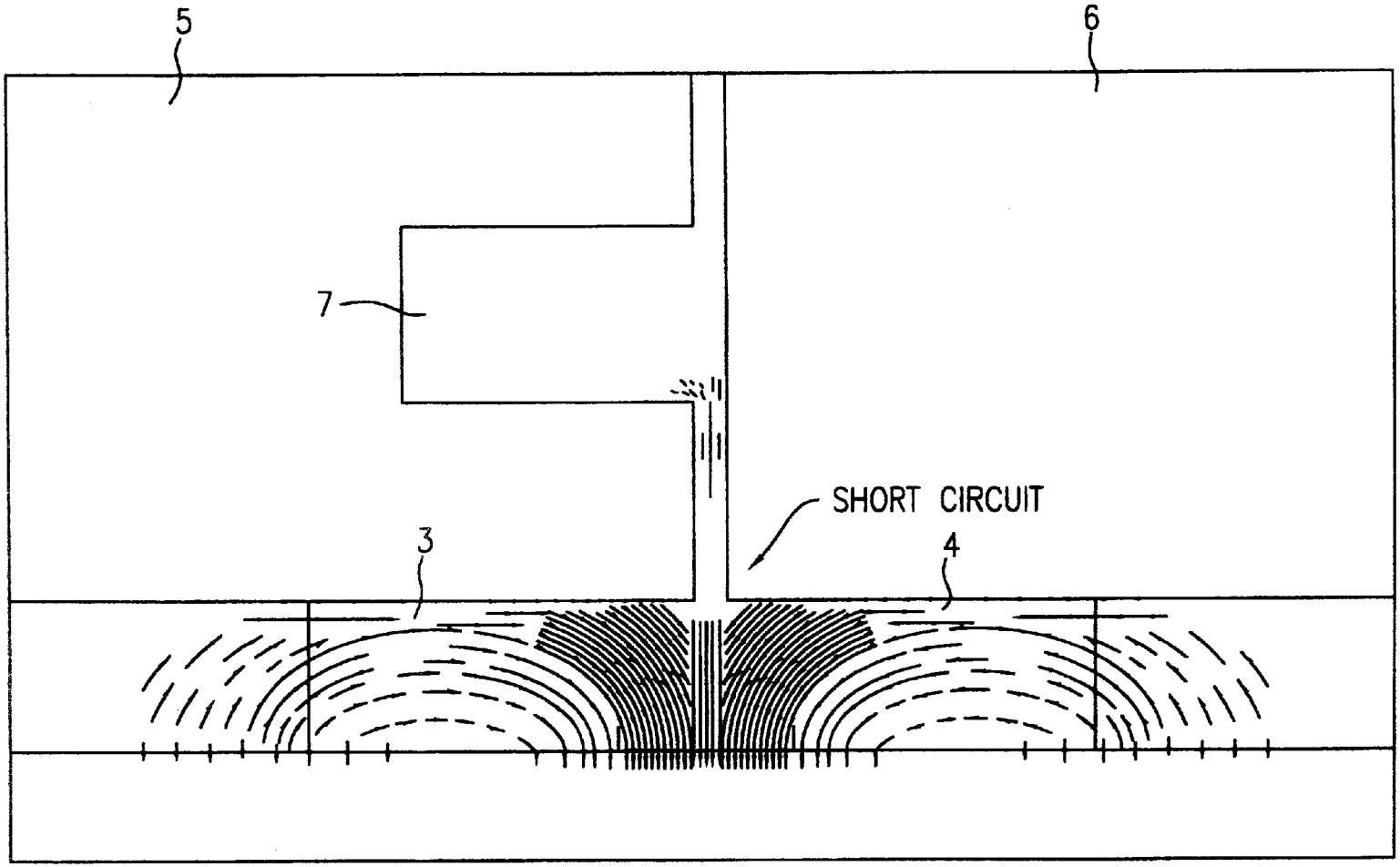
FIG. 5 schematically illustrates an example of the magnetic field distribution in the main portion of the directional coupler shown in FIG. 4.

FIG. 5 illustrates the magnetic field distribution when the directional coupler uses magnetic field coupling in the LSE mode. The directional coupler using magnetic field coupling in the LSE mode, in which the conductor is separated in parallel to the direction in which a current flows, is influenced less by the separation of the conductor, thereby causing leakage of the electromagnetic waves to be significantly reduced. Therefore, the loss caused by separating two NRD guides which form the directional coupler is substantially reduced even if there is no choke. A choke would further reduce the leakage loss.

Theoretically, if a gap is generated between the separating surfaces of the two NRD guides, the NRD guides become asymmetric, causing an undesirable mode (the LSM mode) with the result that coupling in such an undesirable mode occurs. However, the NRD guides according to the second embodiment utilize the LSE-mode-only transmission, leading to less coupling in such an undesirable mode and little loss resulting from mode switching.

An antenna device according to a third embodiment of the present invention is described with reference to FIG. 8.

Figure 8:
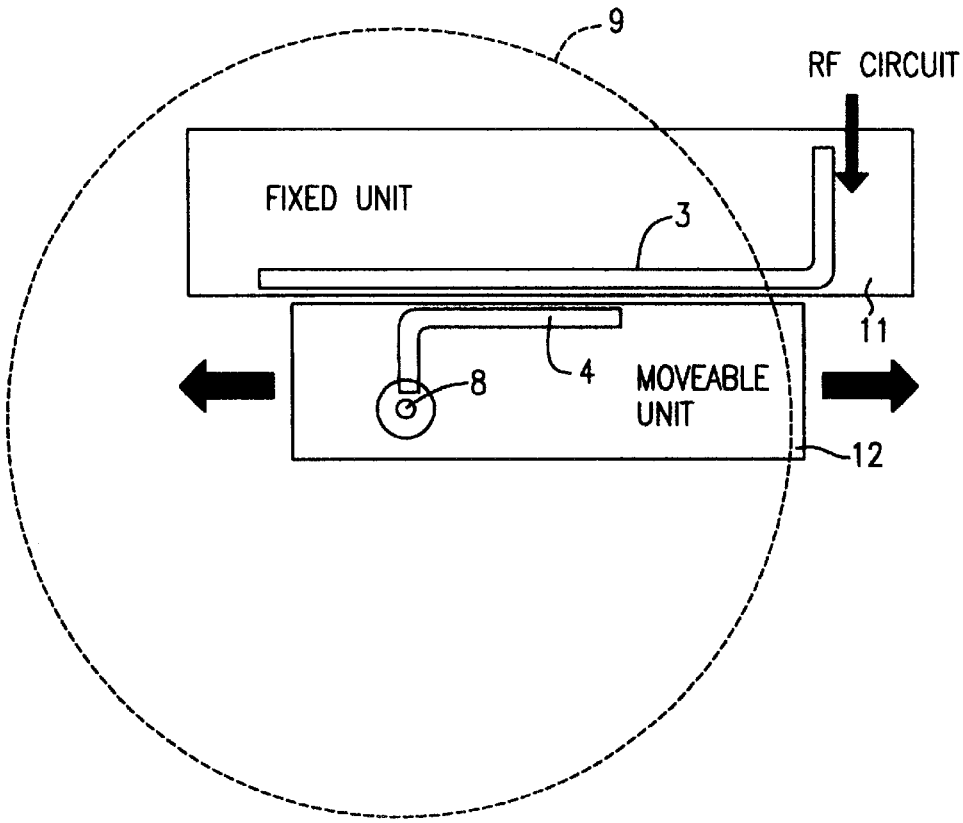
FIG. 8 is a top view of an antenna device according to a third embodiment of the present invention.

FIG. 8 is a top view of the antenna device with an upper conductive plate removed therefrom. The antenna device includes lower conductive plates 11 and 12, dielectric strips 3 and 4 which are formed on the lower conductive plates 11 and 12, respectively, and upper conductive plates (not shown) which are placed over the dielectric strips 3 and 4, respectively, to form two NRD guides. The two lines are coupled at the portion where the dielectric strips 3 and 4 are close to and extend in parallel to each other to provide a directional coupler.

A primary emitter 8 which comprises a dielectric resonator is disposed at one end of the dielectric strip 4, and the upper conductive plate overlying the dielectric strip 4 has an opening formed therein through which electromagnetic waves are emitted or incident in the direction perpendicular thereto. A dielectric lens 9 which substantially focuses onto the primary emitter 8 is further provided.

In FIG. 8, one NRD guide which is composed of the lower conductive plate 12, the upper conductive plate associated therewith, and the dielectric strip 4 formed therebetween, and the primary emitter 8 are located in a movable unit, while the other NRD guide which is composed of the lower conductive plate 11, the upper conductive plate associated therewith, and the dielectric strip 3 formed therebetween are located in a fixed unit. The dielectric lens 9 is also fixed. As the movable unit moves in the directions indicated by arrows in FIG. 8, the relative position of the primary emitter 8 with respect to the dielectric lens 9 is displaced so that beam scanning is performed. Specifically, during transmission, the electromagnetic waves in the LSE mode which are transmitted from a radio frequency (RF) circuit are guided into the primary emitter 8 via the directional coupler, and the electromagnetic waves are emitted in the direction perpendicular to the plane of the drawing via the dielectric lens 9. When the electromagnetic waves are incident in the reverse direction, a reception signal allows them to be propagated in the LSE mode in the NRD guide in the movable unit via the primary emitter 8, and to be propagated in the LSE mode in the NRD guide in the fixed unit via the directional coupling portion. Then, the reception signal is transmitted to the RF circuit.

A radar system according to a fourth embodiment of the present invention is described with reference to FIG. 9.

Figure 9:
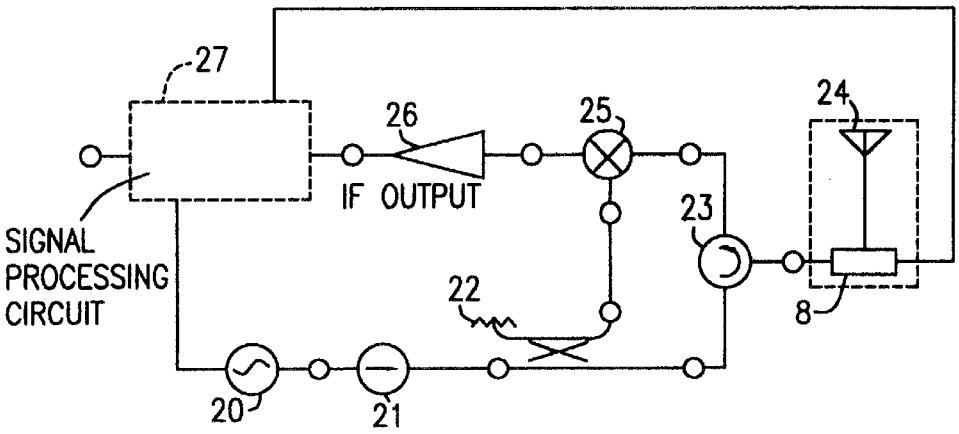
FIG. 9 is a block diagram of a radar system according to a fourth embodiment of the present invention.

In FIG. 9, the radar system includes a voltage controlled oscillator (VCO) 20 incorporating a Gunn diode, a varactor diode, and the like, an isolator 21 for preventing a reflected signal from being sent back to the VCO 20, a directional coupler 22 having NRD guides for extracting a portion of a transmission signal as a local signal, and a circulator 23 for applying the transmission signal to a primary emitter 8 of an antenna 24, and for transmitting the reception signal to a mixer 25. The mixer 25 combines the reception signal with the local signal to output an intermediate frequency signal. An IF amplifier 26 amplifies the intermediate frequency signal, and outputs the resulting signal to a signal processing circuit 27 as an IF signal. The signal processing circuit 27 determines the distance to the target and the relative speed with respect to the target based on the relationship between the modulating signal of the VCO 20 and the reception signal.

The antenna device shown in FIG. 8 is employed between the circulator 23 and the primary emitter 8. As described above, the coupling length L of the directional coupling portion in the antenna device can be shorter than that in a directional coupler having the conventional structure, thereby making the movable unit compact and light. This reduces the load imposed on a linear actuator for driving the movable unit, so that the reliability is improved. The lighter the movable unit which is a load, the more compact the linear actuator, thereby achieving a compact antenna device, and the overall radar system becomes compact accordingly. For the same reason, higher rate beam scanning is possible, and sensing of the target and detection of the distance to the target and the relative speed with respect to the target can be performed in a shorter period over a wider beam scanning range.

Although the present invention has been described in relation to particular embodiments thereof, many other variations and modifications and other uses will become apparent to those skilled in the art. Therefore, the present invention is not limited by the specific disclosure herein.

What is claimed is:

1. A directional coupler comprising:

two non-radiative dielectric lines each comprising a pair of flat conductive surfaces placed substantially parallel to each other, and a dielectric strip disposed therebetween, said two non-radiative dielectric lines being coupled to each other by at least portions of the dielectric strips which are close to and extend in parallel to each other, wherein the main transmission mode of electromagnetic waves being propagated in the non-radiative dielectric lines at the frequency used is an LSE mode, and wherein said pair of flat conductive surfaces are divided at a location between said two non-radiative dielectric lines so as to form separating surfaces, the separating surfaces extending along the longitudinal direction of the two dielectric strips.

2. The directional coupler according to claim 1, wherein the electromagnetic waves at the frequency used are propagated solely in the LSE mode in the non-radiative dielectric lines.

3. The directional coupler according to claim 1, wherein said pair of flat conductive surfaces placed substantially parallel to each other comprise conductive plates which hold the dielectric strips, the opposing surfaces of the conductive plates correspond to the separating surfaces of said two non-radiative dielectric lines, and the opposing surfaces have choke grooves formed therein.

4. An antenna device comprising:

the directional coupler according to claim 3;

a primary emitter connected to one of the non-radiative dielectric lines in said directional coupler; and a dielectric lens which substantially focuses at said primary emitter.

5. A radar system comprising a unit for transmitting and receiving electromagnetic waves, and connected thereto, the antenna device according to claim 4.

6. An antenna device comprising:

the directional coupler according to claim 1;

a primary emitter connected to one of the non-radiative dielectric lines in said directional coupler; and a dielectric lens which substantially focuses at said primary emitter.

7. A radar system comprising a unit for transmitting and receiving electromagnetic waves, and connected thereto, the antenna device according to claim 6.

* * * * *